US007309059B2

(12) United States Patent
Marcil

(10) Patent No.: US 7,309,059 B2
(45) Date of Patent: Dec. 18, 2007

(54) HOIST APPARATUS ROPE SENSING DEVICE

(75) Inventor: Joseph A. Marcil, Burlington, WI (US)

(73) Assignee: MHE Technologies, Inc., Wilmington, DE (US)

( * ) Notice: Subject to any disclaimer, the term of this patent is extended or adjusted under 35 U.S.C. 154(b) by 197 days.

(21) Appl. No.: 10/547,272

(22) PCT Filed: Mar. 7, 2003

(86) PCT No.: PCT/US03/07011

§ 371 (c)(1),
(2), (4) Date: Aug. 29, 2005

(87) PCT Pub. No.: WO2004/080882

PCT Pub. Date: Sep. 23, 2004

(65) Prior Publication Data

US 2006/0163546 A1 Jul. 27, 2006

(51) Int. Cl.
*B66D 1/48* (2006.01)

(52) U.S. Cl. ..... 254/271; 254/272

(58) Field of Classification Search ..... 254/270, 254/271, 272, 383

See application file for complete search history.

(56) References Cited

U.S. PATENT DOCUMENTS 647,242 A 1/1900 Sprauge
813,451 A 2/1906 Rohlfing et al.
830,944 A 9/1906 Westbrook
1,163,165 A * 12/1915 Mueller ..... 254/271
1,600,477 A 9/1926 Knight
1,764,887 A 6/1930 Posey
2,391,172 A 12/1945 Leland (Continued)

FOREIGN PATENT DOCUMENTS

GB 1 340 326 12/1973

(Continued)

OTHER PUBLICATIONS

Patent Cooperation Treaty International Search Report for International Application No. PCT/US03/07011, mailed Jul. 11, 2003.

*Primary Examiner*—Emmanuel M Marcelo
(74) *Attorney, Agent, or Firm*—Porter, Wright, Morris & Arthur, LLP

(57) ABSTRACT

A hoist apparatus (10) including a rope sensing device (14) for detecting rope fouling events. The rope sensing device (14) includes a lever arm (74) having a first end portion (74*g*), a second end portion (74*h*), and a pivot point (74*j*) located between the first (74*g*) and second (74*h*) end portions along the lever arm (74). The lever arm (74) is pivotably mounted to a frame (18) of the hoist apparatus for movement between a sensing position and a fouled position. A follower (78) is connected to the first end portion (74*g*) and positioned adjacent and spaced from a drum (30) of the hoist apparatus such that rope (38) winds on to the drum spaced from and relative to the follower (78) when the rope sensing device is in the sensing position. A switch actuator (82) is connected to the second end portion (74*h*) adjacent a switch (86) such that the switch is actuated to a motor stop position when a rope fouling event occurs.

23 Claims, 4 Drawing Sheets

U.S. PATENT DOCUMENTS 2,493,129 A 1/1950 Gahagan
3,158,355 A 11/1964 Wilson
3,208,729 A 9/1965 Townsen
4,042,213 A * 8/1977 Schreyer et al. ..... 254/270
4,213,019 A 7/1980 Houp
4,854,547 A 8/1989 Oliphant
5,335,895 A 8/1994 Sell
5,988,596 A 11/1999 Mitchell et al.
6,003,843 A 12/1999 Fujiwara et al.
6,811,112 B1 * 11/2004 Currie et al. ..... 242/534.1
6,916,015 B2 * 7/2005 Andreasson ..... 254/270

FOREIGN PATENT DOCUMENTS

JP 0035953 11/1979

* cited by examiner

HOIST APPARATUS ROPE SENSING DEVICE

BACKGROUND OF THE INVENTION

The invention relates to hoist apparatus, and more particularly, to rope sensing devices for hoist apparatus.

Hoist apparatus typically include a drum that is selectively rotated by a motor. A rope wound around the drum winds on to and off of the drum in response to rotation of the drum in opposite directions. Often, the drum has a helical groove in which the rope is reeved as the rope winds on to the drum. A load engaging device is supported by the rope such that the load engaging device moves up and down as the rope winds on to and off of the drum.

Various rope sensing devices have been used to detect rope fouling events. Nevertheless, a new rope sensing device that provides enhanced rope fouling event detection would be welcomed by those in the art.

SUMMARY OF THE INVENTION

The invention provides a rope sensing device that detects rope fouling events on a rope winding device. The rope sensing device includes a lever arm having a first end portion, a second end portion, and a pivot point located between the first and second end portions along the lever arm. The lever arm is pivotably mounted to a frame of the rope winding device for movement between a sensing position and a fouled position. A follower is connected to the first end portion and positioned adjacent and spaced from a drum of the rope winding device such that rope winds on to the drum spaced from and relative to the follower when the rope sensing device is in the sensing position. A switch actuator is connected to the second end portion adjacent a switch such that the switch is actuated to a motor stop position when a rope fouling event occurs.

Further objects of the present invention together with the organization and manner of operation thereof, will become apparent from the following detailed description of the invention when taken in conjunction with the accompanying drawings wherein like elements have like numerals throughout the drawings.

BRIEF DESCRIPTION OF THE DRAWINGS

The present invention is further described with reference to the accompanying drawings, which show an embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention. Also, it is understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," and "coupled" are used broadly and encompass both direct and indirect mountings, connections, and couplings. Further, "connected" and "coupled" are not restricted to physical or mechanical connections or couplings.

DETAILED DESCRIPTION

Figure 1:
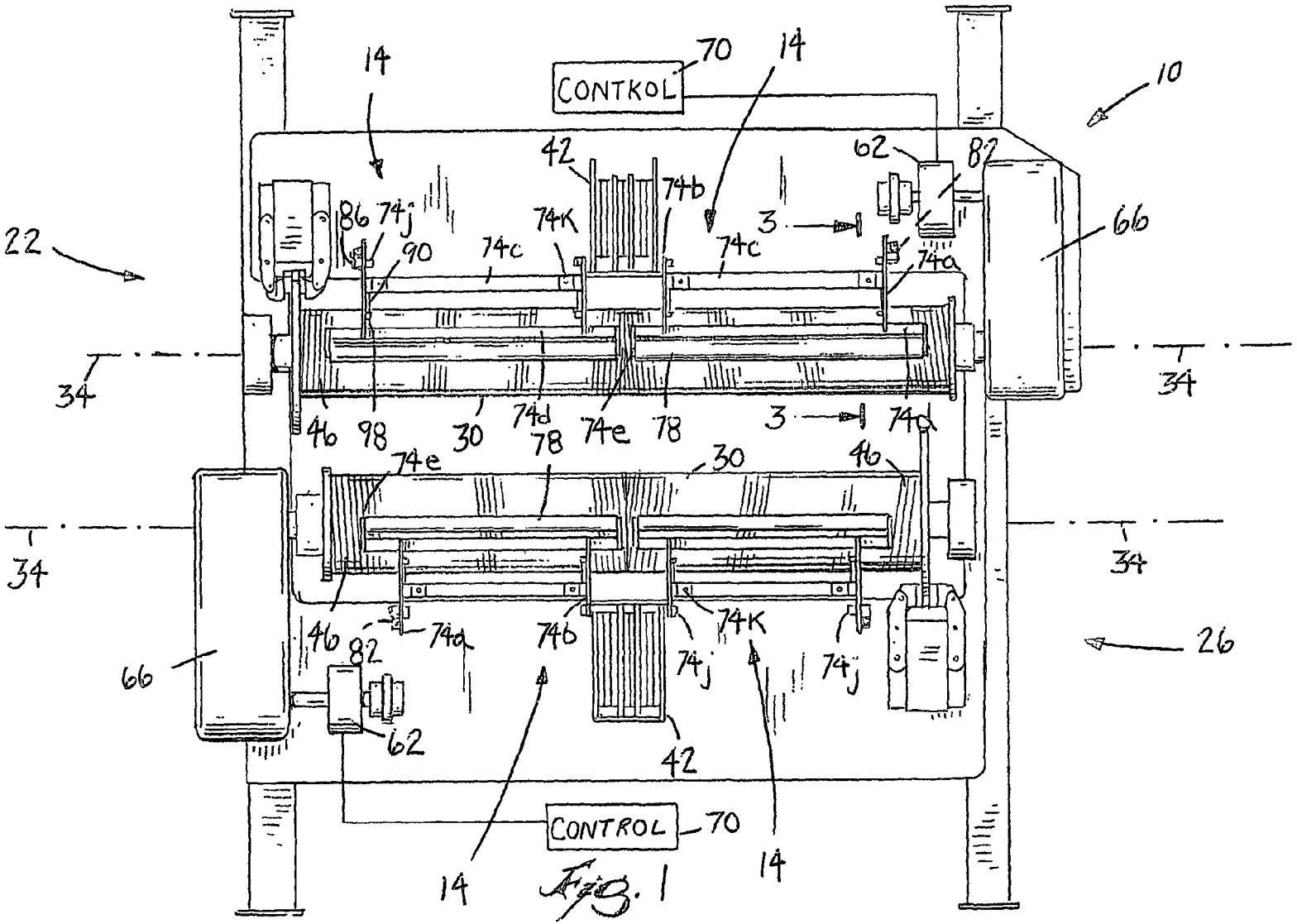
FIG. 1 illustrates a top view of a hoist apparatus including a rope sensing device according to one embodiment of the invention.
Figure 2:
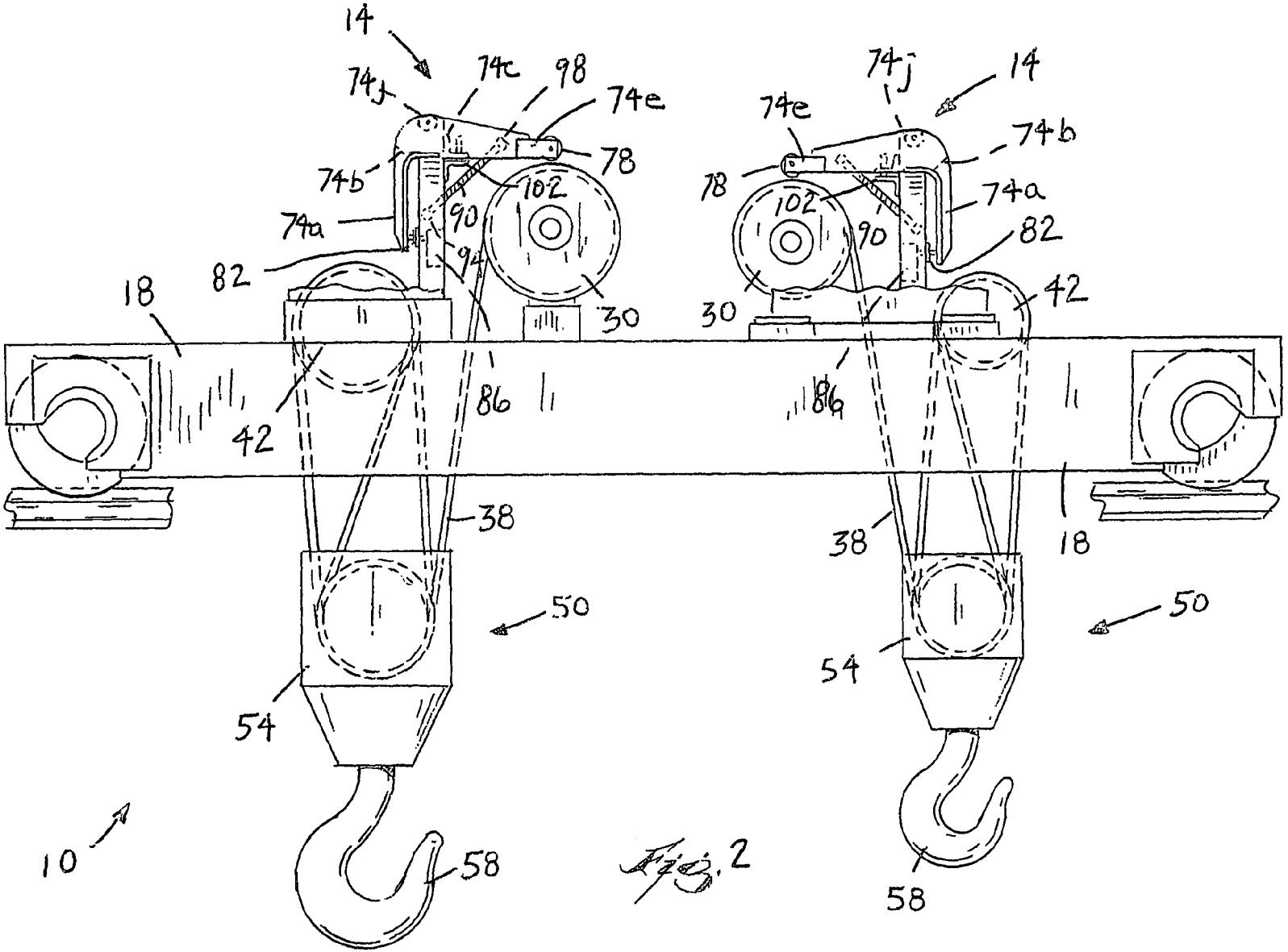
FIG. 2 illustrates a side view of the hoist apparatus of FIG. 1.

FIGS. 1 and 2 illustrate an overhead traveling crane or hoist apparatus 10 that includes a rope sensing device 14 according to one embodiment of the invention. It should be understood that the rope sensing device 14 of the present invention is capable of use on other rope winding devices (e.g., other types of overhead traveling cranes, hoist apparatus, winches, and the like) and the hoist apparatus 10 is merely shown and described as one such example.

The hoist apparatus 10 includes a frame 18 movable above the ground or the floor of a warehouse or other building in which the hoist apparatus 10 operates. The hoist apparatus 10 includes a main hoist 22 mounted to the frame 18 and an auxiliary hoist 26 mounted to the frame 14. The main and auxiliary hoists 22 and 26 have similar constructions, and accordingly, only the main hoist 22 is discussed herein. Like reference numerals are used in the drawings to identify like elements of the main and auxiliary hoists 22 and 26.

The main hoist 22 includes a hoist drum 30 mounted on the frame 18 for rotation about a generally horizontal drum axis 34. A hoist rope 38 is wound around the drum 30 such that the rope 38 winds on to and off of the drum 30 in response to rotation of the drum 30 in opposite wind-up (clockwise in FIG. 2 for the main hoist 22) and wind-off (counterclockwise in FIG. 2 for the main hoist 22) directions, respectively. In one embodiment, the rope 38 is a wire rope. In other embodiments, the rope 38 may be cable, chain, or other types of rope. The ends of the rope 38 are fixed to the drum 30 adjacent the outer ends of the drum 30, and the middle portion of the rope 38 passes through an equalizer or upper sheave 42 that is fixed to the frame 18 at a point spaced from the drum 30. The drum 30 has a generally cylindrical outer surface having therein a pair of helical grooves 46. The portions of the rope 38 adjacent the ends are reeved in respective grooves 46 as the rope 38 winds on to the drum 30. The rope 38 moves in its groove 46 from a maximum wind-off position near the end of the drum 30 toward a maximum wind-on position near the middle of the drum 30 as the rope 38 winds on to the drum 30. This rope arrangement is known as a double-reeve arrangement. It should be understood that single-reeve rope arrangements could also be utilized.

As illustrated in FIG. 2, a load engaging mechanism 50 is connected to the rope 38. The load engaging mechanism 50 includes a bottom block 54 through which the rope 38 is reeved, and a hook 58 depending from the bottom block 54. As is known in the art, the load engaging mechanism 50 moves upward when the rope 38 winds on to the drum 30 and moves downward when the rope 38 winds off of the drum 30. As illustrated in FIG. 1, the main hoist 22 also includes a motor 62 that is mounted on the frame 18 and that is connected to the drum 30 by a gear case 66 for selectively rotating the drum 30 in the opposite wind-up and wind-off directions. A control 70 (shown schematically in FIGS. 1,3, and 4) is operably connected to the motor 62 for controlling rotation of the drum 30. The hoist apparatus 10 as thus far described is conventional and need not be described in greater detail.

Figure 5:
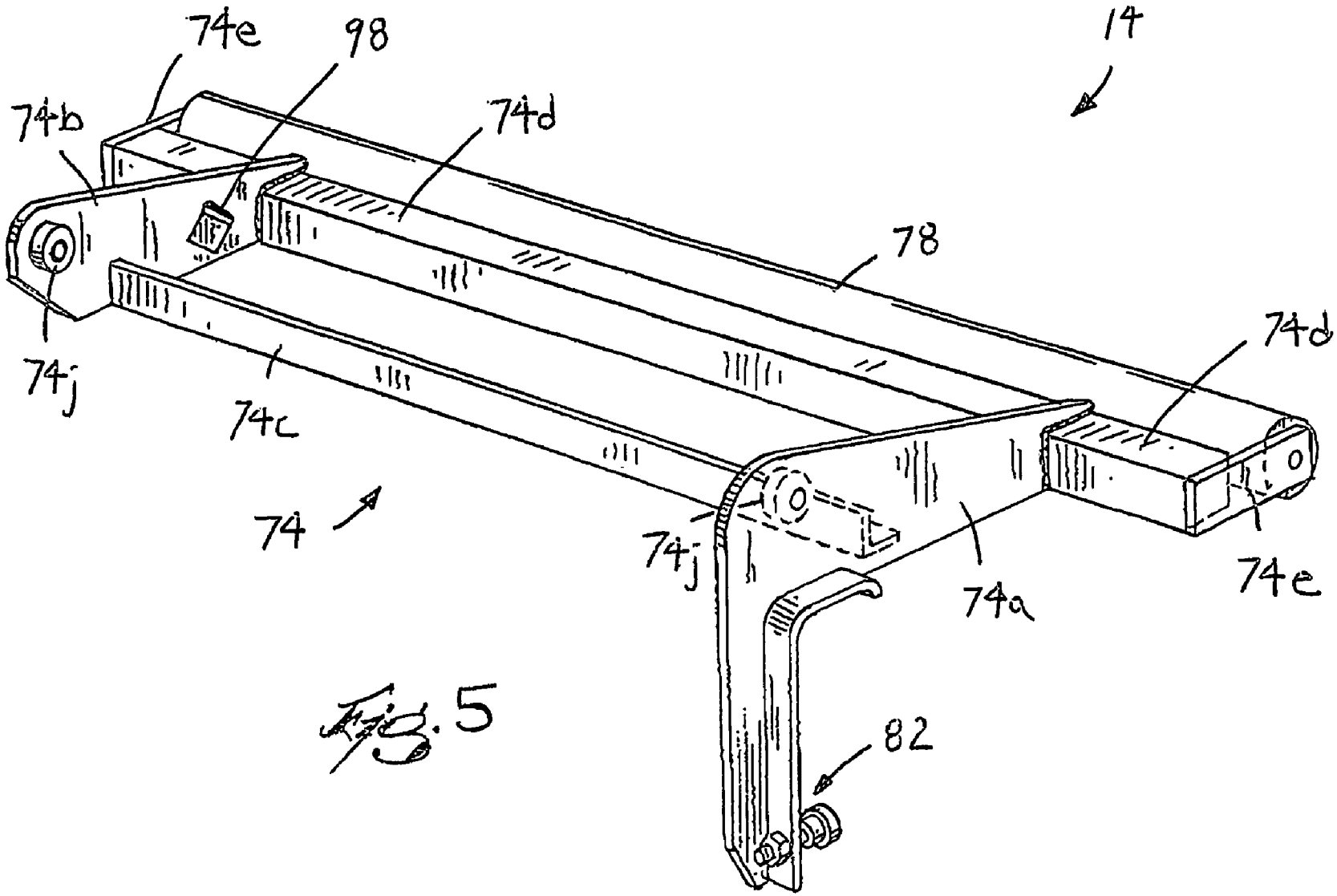
FIG. 5 illustrates a perspective view of the rope sensing device of FIG. 1.

As shown in FIG. 1, the main and auxiliary hoists 22 and 26 each include two rope sensing devices 14. As discussed above, because the rope arrangement is a double-reeve arrangement, the rope 38 reeves on to the drum in two locations. Each rope sensing device 14 extends over approximately one half of the axial length of the drum 30 (i.e., between the maximum wind-off and maximum wind-on positions) to detect rope fouling events, as discussed further below, in one of the two locations. In other embodiments, other configurations of rope sensing devices 14 may be utilized (e.g., a single rope sensing device may extend over approximately the entire axial length of a drum between a maximum wind-off and a maximum wind-on position of a single reeve rope arrangement). As shown in FIGS. 1 and 5, the illustrated rope sensing device 14 includes a lever arm 74, a follower 78 connected to the lever arm, and a switch actuator 82 connected to the lever arm 74. In some embodiments, the follower 78 and/or the switch actuator 82 may be integrally connected to the lever arm 74.

Figure 4:
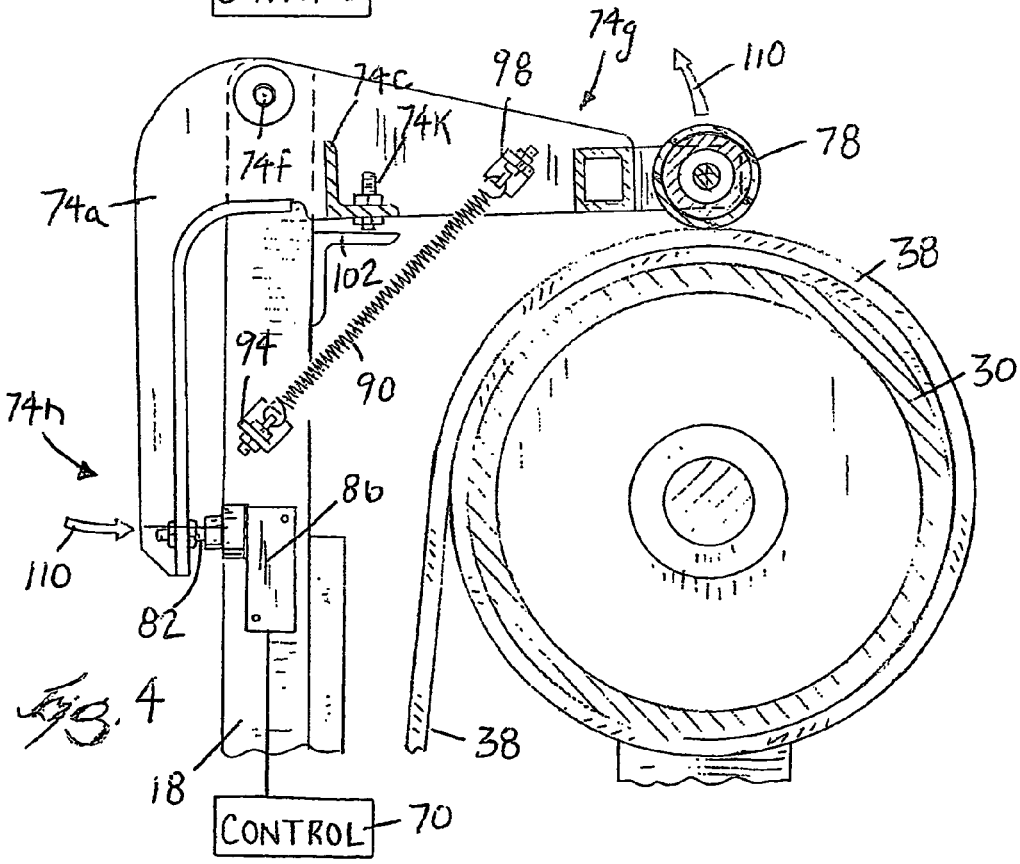
FIG. 4 illustrates a view similar to FIG. 3 showing the rope sensing device positioned in a fouled position.

As best shown in FIG. 5, the lever arm 74 includes an L-shaped member 74*a* and a straight member 74*b* interconnected by an elongated angular member 74*c* and an elongated tubular member 74*d*. A follower supporting bracket 74*e* extends from each end of the tubular member 74*d* to support the follower 78. As illustrated in FIG. 4, the lever arm 74 is pivotably connected to the frame 18 at a pivot point 74*f*. The pivot point 74*f* is located between a first end portion 74*g* and a second end portion 74*h* of the lever arm 74 along the L-shaped member 74*a*. The lever arm 74 may be pivotably connected to the frame 74*e* by a pivot pin 74*i* and bearing 74*j*. In other embodiments, the lever arm 74 may be alternatively constructed and connected to the frame 18.

The illustrated follower 78 includes an elongated roller 78. The roller 78 is a steel roller and includes a polyurethane coating 78*a* that reduces wear when the rope 38 contacts the roller 78 as discussed further below. The roller 78 may be connected to the brackets 74*e* by bearings 78*b* for rotation about a roller axis 78*c* (see FIG. 2). In other embodiments, the follower 78 may include a bar or other stationary member.

Figure 3:
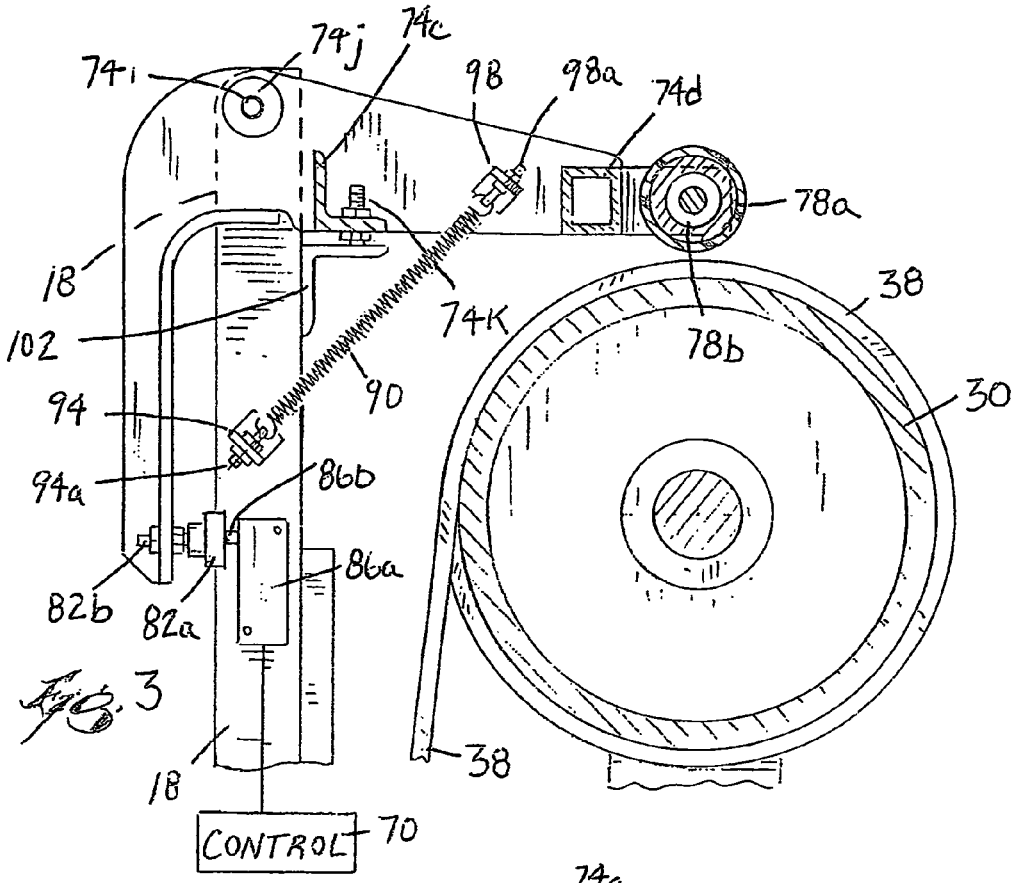
FIG. 3 illustrates a sectional view of the hoist apparatus of FIG. 1 taken along line 3-3 showing the rope sensing device positioned in a sensing position.

The illustrated switch actuator 82 includes an actuating portion 82*a* and an adjustment portion 82*b*. The adjustment portion 82*b* includes a threaded member that allows for adjustment of the position of the actuating portion 82*a* relative to the lever arm 74. As shown in FIGS. 3 and 4, the adjustment portion 82*b* is threaded through a flange of the L-shaped member 74*a* and secured using a lock nut on each side of the flange. In other embodiments, the switch actuator 82 may be alternatively constructed and connected to the lever arm 74.

A limit switch 86 is mounted to the frame 18 adjacent the second end portion 74*h* of the L-shaped member 74*a*, such that the lever arm 74 moves relative to the switch 86. The switch 86 includes a housing 86*a* and an actuatable portion 86*b*. The actuatable portion 86*b* is movable between a motor run position (see FIG. 3) and a motor stop position (see FIG. 4). The control 70 is operably connected to the switch 86 such that the switch 86 signals the control 70 to prevent the motor 62 from further rotating the drum 30 in the wind-on direction when the switch 86 is actuated to the motor stop position, thereby preventing further winding of the rope 38 on the drum 30. The illustrated switch 86 is linearly actuated and prevents the motor 62 from rotating the drum 30 when the actuatable portion 86*b* is depressed. In other embodiments, other types of switches may be utilized. Although the illustrated rope sensing device 14 includes only one limit switch 86, other constructions may include multiple switches. In one embodiment, the switch 86 is connected to the frame 18 a distance from the pivot point 74*f* that allows for complete actuation of the switch 86 to the motor stop position when a rope fouling event occurs. The inventor has found that placement of the switch 86 away from the pivot point 74*f* enhances rope fouling event detection by decreasing false and missed detection of rope fouling events. In one embodiment, the switch 86 is spaced from the pivot point 74*f* by approximately fourteen inches. In other embodiments, the spacing may vary based on the manner of switch actuation.

The rope sensing device 14 is pivotable between a sensing position (see FIGS. 2 and 3) and a fouled position (see FIG. 4). When the rope sensing device 14 is positioned in the sensing position, the actuating portion 82*a* of the switch actuator 82 is positioned adjacent the actuatable portion 86*b* of the switch 86. Further, the follower 78 is positioned adjacent and spaced from the drum 30 such that the rope 38 winds on to the drum 30 relative to the follower 78. In one embodiment, the follower 78 is substantially parallel to and spaced from the generally cylindrical outer surface of the drum 30. In some embodiments, the follower 78 is spaced from the drum 30 by a distance that allows the rope 38 to wind on to and off of the drum during normal operation without contacting the follower 78, but contact the follower 78 when a rope fouling event occurs.

It is generally not desirable to wind rope 38 on to the drum 30 after a rope fouling event has occurred. As used herein, a rope fouling event is meant to encompass placement of the rope 38 on the drum 30 radially beyond the location the rope 38 is intended to be wound on the drum 30. On the illustrated hoist apparatus 10, a rope fouling event may occur when the rope 38 jumps out of the groove 46 and is positioned either on top of rope 38 already wound on the drum 38 or across a top portion of a subsequent groove 46. Either type of rope fouling event may result in unintended movement of a load attached to the load engaging device 50. In other embodiments, a rope fouling event includes detection of a maximum number of wraps or levels of rope on a drum.

The lever arm 74 is biased towards the sensing position by a pair of springs 90 such that the lever arm 74 does not pivot toward the fouled position as a result of extraneous forces (e.g., vibration of the hoist apparatus). A first set of spring mounts 94 are connected to the frame 18. A second set of spring mounts 98 are connected to the lever arm 74. As illustrated in FIGS. 3 and 4, each spring 90 is connected between a first spring mount 94 and a second spring mount 98. The illustrated spring mounts 94 and 98 each include an adjustment portion 94*a* and 98*a*, respectively. The adjustment portions 94*a* and 98*a* includes a threaded member that allows for adjustment of the spring constant of the spring 90 and thus the bias force exerted by the spring 90. As shown in FIGS. 3 and 4, each adjustment portion 94*a* and 98*a* is threaded through a respective spring mount 94 and 98 and secured using a lock nut. In other embodiments, the biasing member may be alternatively constructed and connected to the lever arm 74. In other embodiments, the lever arm 74 may be alternatively biased towards the sensing position. In yet other embodiments, the lever arm 74 may not be biased towards the sensing position.

A limit stop 102 establishes the position of the follower 78 relative to the drum 30 when the rope sensing device 14 is in the sensing position. The illustrated limit stop 102 includes a bracket 102 connected to the frame 18. A portion of the lever arm 74 contacts the limit stop 102 such that the limit stop 102 prevents the lever arm 74 from pivoting further toward the drum 30. The illustrated lever arm 74 includes an adjustment portion 74*k* connected to the elongated angular member 74*c*. The adjustment portion 74*k* includes a threaded member that allows for adjustment of the spacing between the follower 78 and the generally cylindrical outer surface of the drum 30. As shown in FIGS. 3 and 4, the adjustment portion 74*k* is threaded through the elongated angular member 74*c* and secured using a lock nut on each side of the elongated angular member 74*c*. In other embodiments, the adjustment portion 74*k* is alternatively constructed and connected to the lever arm 74.

For operation, the rope sensing device 14 remains positioned in the sensing position until a rope fouling event occurs which causes the rope 38 to contact the follower 78 and pivot the lever arm 74 from the sensing position to the fouled position. As illustrated in FIG. 4, the rope 38 is wound on top of itself instead of the drum 30. Although some rope winding devices wind multiple layers or wraps of rope on a drum, the illustrated hoist apparatus 10 is designed to wind only a single layer of rope 38 on the drum 30. Accordingly, a rope fouling event has occurred which caused the rope 38 to contact the roller 78. Arrows 110 illustrated in FIG. 4 show the direction of travel of the pivotable movement from the sensing position to the fouled position. As the lever arm 74 pivots towards the fouled position, the switch actuator 82 actuates the switch 86 from the motor run position to the motor stop position. The switch 86 signals the control 70 to prevent the motor 62 from rotating the drum 30 further when the switch 86 is actuated to the motor stop position. An operator can then correct the rope fouling event.

The inventor has found that the adjustment features of the invention enhance rope fouling event detection. More specifically, the inventor has found that adjustment of the position of the follower 78 relative to the drum 30, adjustment of the position of the actuating portion 82*a* relative to the actuatable portion 86*b*, and/or adjustment of the bias force exerted by the spring 90 enhance rope fouling event detection by allowing a person of skill in the art to set the rope sensing device in the sensing position for optimum performance. The adjustment features allow a person of skill in the art to compensate for manufacturing tolerances in the components of the rope sensing device 14. Further, the inventor has found that use of bearings 78*b* and 74*j* enhance rope fouling event detection by allowing the lever arm 74 to move freely without binding on the frame 18 and that use of the cover 78*a* extends the useful life of the rope 38 and the follower 78.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

What is claimed is:

1. A hoist apparatus comprising:

a frame;

a drum mounted on the frame for rotation about a drum axis;

a motor connected to the drum for selectively rotating the drum in opposite wind-up and wind-off directions about the drum axis;

a rope wound around the drum such that the rope winds on to and off of the drum in response to rotation of the drum in the wind-up and wind-off directions, respectively;

a switch mounted to the frame and preventing the motor from rotating the drum when the switch is actuated to a stop motor position; and a rope sensing device pivotable between a sensing position and a fouled position, the rope sensing device including a lever arm having a first end portion, a second end portion, and a pivot point located between the first and second end portions along the lever arm, the lever arm being pivotably connected to the frame at the pivot point, a follower connected to the first end portion and positioned adjacent and spaced from the drum such that the rope winds on to the drum spaced from and relative to the follower when the rope sensing device is in the sensing position, and a switch actuator connected to the second end portion adjacent the switch, the rope sensing device being biased towards and positioned in the sensing position until a rope fouling event occurs and causes the rope to contact the follower and pivot the lever arm from the sensing position to the fouled position, the switch actuator actuating the switch to the motor stop position when the rope sensing device is in the fouled position.

2. A hoist apparatus according to claim 1 and further comprising a control operably connected to the motor and the switch, wherein the control controls rotation of the drum, and wherein the switch signals the control to prevent the motor from rotating the drum when the switch is actuated to the stop motor position.

3. A hoist apparatus according to claim 1 wherein the drum includes a helical groove in which the rope is reeved as the rope winds on to the drum, and wherein a rope fouling event occurs when the rope leaves the helical groove.

4. A hoist apparatus according to claim 1 and further comprising a load engaging mechanism connected to the rope such that the load engaging mechanism moves upward when the rope winds on to the drum and moves downward when the rope winds off of the drum.

5. A hoist apparatus according to claim 1 wherein the follower includes a roller connected to the lever arm for rotation about a roller axis, and wherein the roller axis is substantially parallel to the drum axis.

6. A hoist apparatus according to claim 5 wherein the roller includes a polyurethane cover.

7. A hoist apparatus according to claim 5 wherein the rope sensing device further includes a bearing that connects the roller to the lever arm for rotation about the roller axis.

8. A hoist apparatus according to claim 1 wherein the rope sensing device further includes a bearing that pivotably connects the lever arm to the frame at the pivot point.

9. A hoist apparatus according to claim 1 wherein the lever arm is biased towards the sensing position by a spring.

10. A hoist apparatus according to claim 9 further comprising a first spring mount connected to the frame, wherein the rope sensing device includes a second spring mount connected to the lever arm, wherein the spring is connected between the first and second spring mounts, and wherein at least one of the first and second spring mounts is adjustable to adjust the bias force exerted by the spring on the lever arm.

11. A hoist apparatus according to claim 1 wherein the switch actuator includes an actuating portion, and wherein the position of the actuating portion relative to the switch is adjustable.

12. A hoist apparatus according to claim 1 wherein the switch actuator linearly actuates the switch.

13. A hoist apparatus according to claim 1 wherein the position of the follower portion relative to drum is adjustable.

14. A hoist apparatus according to claim 13 wherein a portion of the frame contacts a portion of the lever arm to establish the position of the follower portion relative to the drum.

15. A hoist apparatus according to claim 1 wherein the rope is wound around the drum in a double-reeve rope arrangement, and further comprising a second rope sensing device positioned adjacent the drum to detect a rope fouling event.

16. A hoist apparatus according to claim 15 wherein the follower of the first mentioned rope sensing device extends approximately one half of the axial length of the drum to sense a first portion of the double-reeve rope arrangement winding on to the drum, and wherein a follower of the second rope sensing device extends approximately the other one half of the axial length of the drum to sense a second portion of the double-reeve rope arrangement winding on to the drum.

17. A hoist apparatus according to claim 1 wherein the switch actuator is spaced from the pivot point by a distance that allows for complete actuation of the switch to the motor stop position when a rope fouling event occurs.

18. A hoist apparatus according to claim 1 wherein the lever arm includes an L-shaped member, and wherein the L-shaped member includes a first leg portion and a second leg portion joined to the first leg portion roughly at the pivot point.

19. A hoist apparatus according to claim 18 wherein the first leg portion defines a first length, wherein the second leg portion defines a second length, and wherein the first and second lengths are approximately equal.

20. A hoist apparatus according to claim 18 wherein the follower is connected to the first leg portion, and wherein the switch actuator is connected to the second leg portion.

21. A hoist apparatus according to claim 18 wherein the first and second leg portions are spaced by approximately ninety degrees.

22. A hoist apparatus comprising:

a frame;

a drum mounted on the frame for rotation about a drum axis;

a motor connected to the drum for selectively rotating the drum in opposite wind-up and wind-off directions about the drum axis;

a rope wound around the drum such that the rope winds on to and off of the drum in response to rotation of the drum in the wind-up and wind-off directions, respectively, the rope having a predetermined radial position beyond which it is not desirable to wind rope on to the drum;

a switch mounted to the frame and preventing the motor from rotating the drum when the switch is actuated to a stop motor position; and a rope sensing device pivotable between a sensing position and a fouled position, the rope sensing device including a lever arm having a first end portion, a second end portion, and a pivot point located between the first and second end portions along the lever arm, the lever arm being pivotably connected to the frame at the pivot point, a roller connected to the first end portion for rotation about a roller axis, the roller axis being substantially parallel to the drum axis, the roller being positioned adjacent and spaced from the drum such that the rope winds on to the drum spaced from and relative to the follower when the rope sensing device is in the sensing position, and a switch actuator connected to the second end portion adjacent the switch, the rope sensing device being biased towards and positioned in the sensing position until a rope fouling event occurs and causes the rope to contact the follower and pivot the lever arm from the sensing position to the fouled position, the switch actuator actuating the switch to the motor stop position when the rope sensing device is in the fouled position, a rope fouling event occurring when the rope is positioned radially outward of the predetermined radial position beyond which it is not desirable to wind rope on to the drum.

23. A hoist apparatus comprising:

a frame;

a drum mounted on the frame for rotation about a drum axis;

a motor connected to the drum for selectively rotating the drum in opposite wind-up and wind-off directions about the drum axis;

a rope wound around the drum such that the rope winds on to and off of the drum in response to rotation of the drum in the wind-up and wind-off directions, respectively;

a switch mounted to the frame and preventing the motor from rotating the drum when the switch is actuated to a stop motor position; and a rope sensing device pivotable between a sensing position and a fouled position, the rope sensing device including a lever arm having a first end portion, a second end portion, and a pivot point located between the first and second end portions along the lever arm, the lever arm being pivotably connected to the frame at the pivot point, a roller connected to the first end portion and positioned adjacent and spaced from the drum by a first distance such that the rope winds on to the drum spaced from and relative to the follower when the rope sensing device is in the sensing position, the first distance being adjustable, and a switch actuator connected to the second end portion and positioned adjacent the switch, the position of the switch actuator relative to the switch being adjustable, the rope sensing device being biased by a spring towards and positioned in the sensing position until a rope fouling event occurs and causes the rope to contact the follower and pivot the lever arm from the sensing position to the fouled position, the spring exerting a biasing force, the biasing force being adjustable, the switch actuator actuating the switch to the motor stop position when the rope sensing device is in the fouled position.

* * * * *